US005187813A

United States Patent [19]

Klein

[11] Patent Number: 5,187,813

[45] Date of Patent: Feb. 23, 1993

[54] COMBINATION NAPKIN AND SLEEVE/FOREARM PROTECTOR (CUFF-NAP)

[75] Inventor: Levrette L. Klein, 5725 Painters St., New Orleans, La. 70122

[73] Assignee: Levrette Lee Klein, New Orleans, La.

[21] Appl. No.: 523,478

[22] Filed: May 15, 1990

[51] Int. Cl.[5] ..... A41D 13/08

[52] U.S. Cl. ..... 2/16; 2/59; 2/170

[58] Field of Search ..... 2/16, 170, 59

[56] References Cited

U.S. PATENT DOCUMENTS

| | | | |
|---|---|---|---|
| 293,500 | 2/1884 | Northrup | 2/170 |
| 701,445 | 6/1902 | Wood | 2/59 |
| 731,791 | 6/1903 | Krifka | 2/16 |
| 817,416 | 4/1906 | Cather et al. | 2/59 |
| 964,395 | 7/1910 | Colby | 2/59 |
| 976,693 | 11/1910 | Reichenbach | 2/59 |
| 1,227,052 | 5/1917 | Hogan | 2/59 |
| 1,266,266 | 5/1918 | Hogan | 2/59 |
| 1,278,654 | 9/1918 | Hogan | 2/59 |
| 1,287,691 | 12/1918 | Hogan | 2/59 |
| 1,304,558 | 5/1919 | Grau | 2/16 |
| 4,856,112 | 8/1989 | Effle | 2/16 |
| 4,893,372 | 1/1990 | Wenzel | 2/16 |

*Primary Examiner*—Werner H. Schroeder
*Assistant Examiner*—Gloria Hale

[57] ABSTRACT

A combination napkin and sleeve or forearm protector comprised of an absorbent and flexible disposable paper sheet rectangular in shape when laid out flat and being press-pleated on one side to form a trapezoidal shaped sheet or napkin having press pleats on the narrow side to be worn as a lower arm or sleeve protector. The napkin/protector has adhesive tab or hook and loop type fasteners at the corners adjacent the narrow side. When worn on a wrist by a wearer the napkin is conical in shape flaring upward toward the wearers elbow with the fasteners at the wearers wrist so as to provide coverage protection from exposure to any undesirable element to the forearm or clothing of the wearer.

The napkin may be constructed of heavier materials or reusable cloth material as desired with additional fasteners on the sides of the protector to attach the protector to the arm of the wearer up to the elbow.

When not worn by a wearer the napkin/sleeve protector can be used as a napkin.

3 Claims, 3 Drawing Sheets

FIG. 1. A.

COMBINATION NAPKIN AND SLEEVE/FOREARM PROTECTOR (CUFF-NAP)

BACKGROUND OF THE INVENTION

This invention is a forearm or sleeve protector which when worn by a wearer is attached to the wearers wrist. The napkin/protector is made of an absorbent and flexible paper or cloth which when attached to the wearer's wrist will prevent contamination of the forearm or clothing of the wearer. The napkin/protector can then be easily removed from the wearer's forearm and used as a napkin to remove contamination or perpiration from the wearer's face or hands or any other desired surface. The protector or napkin also has protection and cleaning capabilities.

PRIOR ART

Many prior art references disclose sleeve protectors to be attached to the forearm of the wearer to protect the wearer's forearm or clothing from contamination. These include: U.S. Pat. No. 701,445 to Wood, dated Jun. 3, 2903; U.S. Pat. No. 817,416 to Cather et al., dated Apr. 10, 1906; U.S. Pat. No. 964,395 to Colby dated Jul. 12, 1910; U.S. Pat. No. 976,693 to Reichenbach dated Nov. 22, 1910; U.S. Pat. No. 1,227,052 to Hogan, dated May 22, 1917; U.S. Pat. No. 1,278,654 to Hogan dated Sep. 10, 1918 and U.S. Pat. No. 1,287,691 to Hogan dated Dec. 17, 1918.

All of the above prior art references disclose sleeve or forearm protectors constructed of stiff paper or cardboard materials that only protect the sleeve or forearm of the wearer and do not perform the dual function as a napkin or towel to wipe the face or hands of the wearer or any other surface while worn or removed from the wrist of the wearer.

U.S. Pat. No. 4,856,112 is designed specifically for protection from the penetration of snow in cold terrain. This invention does not have the same object, use or composition.

U.S. Pat. No. 4,893,372 differs in fabrication and utilization since it is specifically designed for and limited to wiping. The utilization of the fingers and hands are limited due to the obtrusive fitting which is not specifically designed for the protection of the forearm and/or clothing of the wearer.

SUMMARY OF THE INVENTION

The object of the invention is to provide a disposable napkin/protector (or reusable cloth version from syntheic or natural fibers as desired), which will be secured at the wrist of the wearer. The invention will serve for both protection of the forearm of the wearer and their clothing while worn and for wiping and will be easy to put on or to remove.

The dual purpose of protecting the wearer and wiping is unique.

The securement of the protector may be accomplished by adhesive tabs, tape, hook and loop or other types of fasteners dependent on the type of material used to construct the protector. When heavier materials are used more than one fastener may be needed to secure the protector to the wrist of the wearer.

The protector/napkin can provide protection in cooking in private or commercial ventures. The protector/napkin can be used for wiping the chin or mouth as needed and thus prevent substances from dripping to other areas of the body or clothing. Wearing the napkin/protector can prevent food and liquids from flowing down the rear of the wrist and forearm (especially in the case of infants and children) and thus absorbing and preventing the staining of clothing.

When worn the napkin/protector is secured from the wind during such outdoor activities as barbecues, beach parties, picnics etc., and remains attached to the wrist of the wearer until deliberately removed.

For office use, the wrist and forearm areas (and their clothing) will be protected during clerical, artistic or architectural drafting procedures.

The napkin/protector may also be used in sports activities or other outdoor activities where perspiration may result. The napkin/protector can be made of many different types of materials such as fire retardent or chemically resistant materials.

BRIEF DESCRIPTION OF THE DRAWINGS

FIG. 1A is a top perspective of the cloth (or other material) version.

DETAILED DESCRIPTION OF THE INVENTION

Napkins are used for many purposes. They are used for wiping the face and hands or any other surface of food products or grease and for the absorption of fluids and undesirable contaminants. Restaurants, fast food franchises and institutions such as schools, hospitals and homes for the elderly are all potential users.

The napkin/protector of the present invention is a forearm application used between the wrist and the elbow although usable on or off the wrist and being made of more than one type of material depending on the purpose of its use. The utilization of other natural or synthetic materials such as cloth or plastics expands the protective capabilities of the protector to deter chemical contact or flammability.

Figure 1:
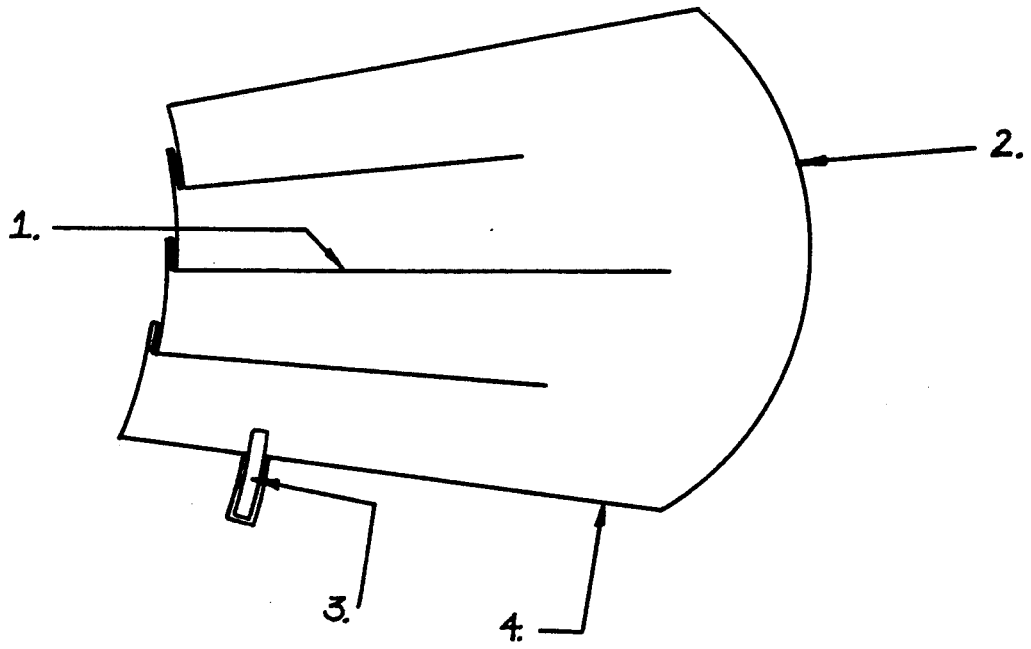
FIG. 1 is a top perspective, unattached to the forearm, usable as is.
Figure 1:
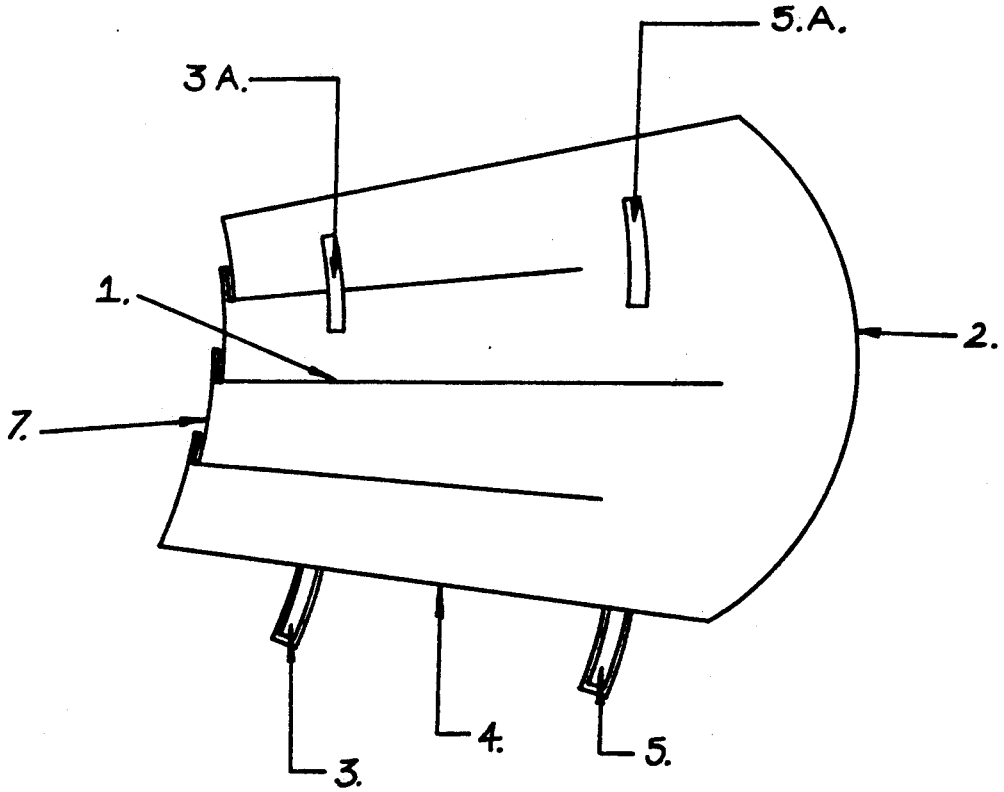
Figure 2:
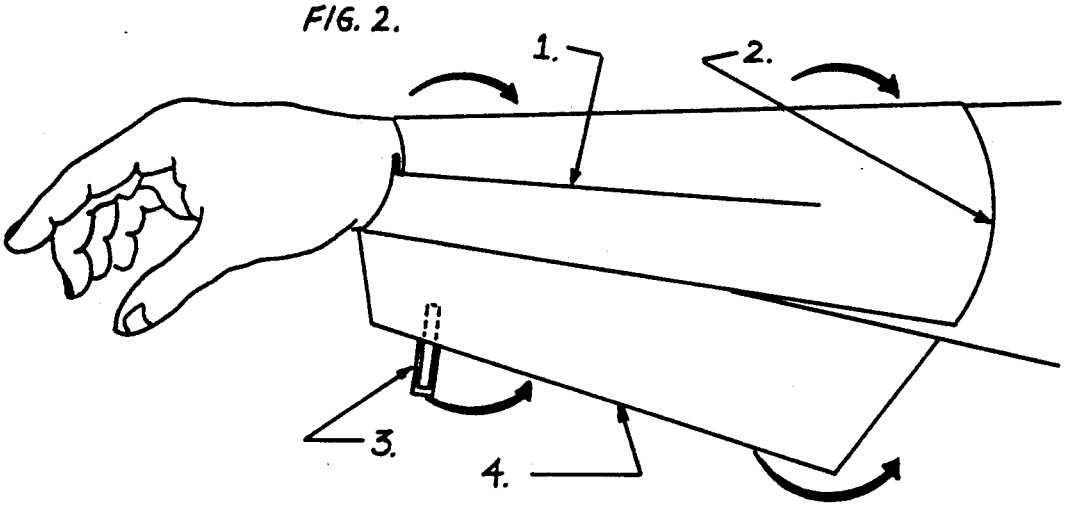
FIG. 2 is a perspective of the method of attaching to the forearm, either right or left.
Figure 3:
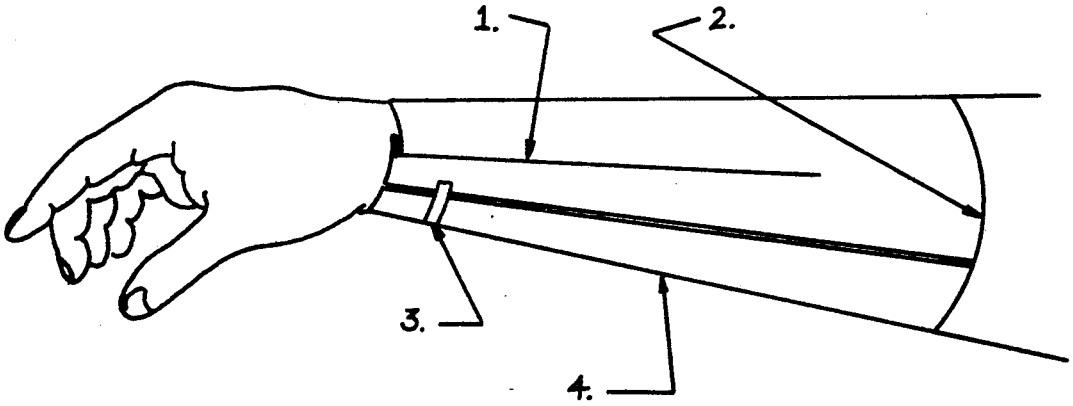
FIG. 3 is a perspective of the completed attachment on the forearm, ready for use.
Figure 4:
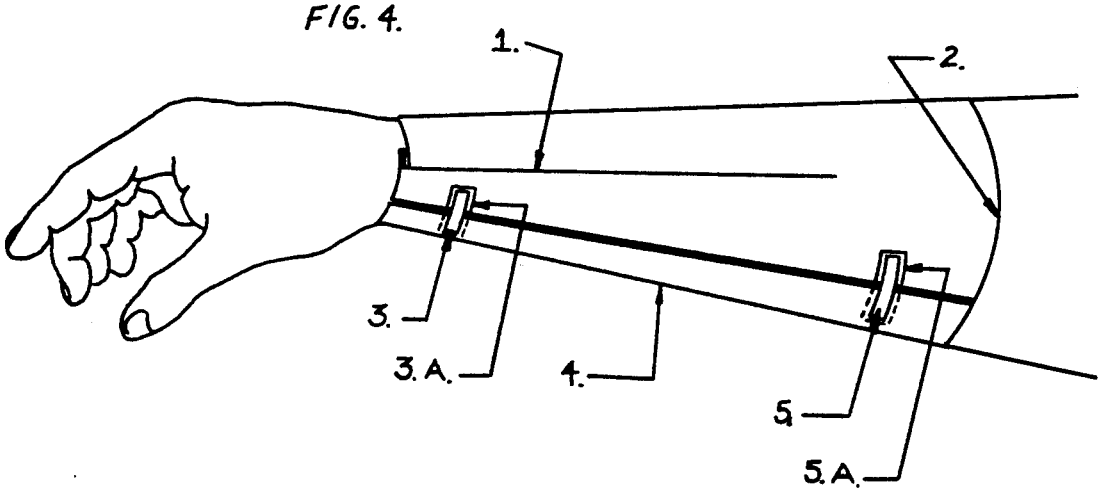
FIG. 4 is a perspective of the completed cloth (or other material) version on the forearm, ready for use.

The napkin/protector is formed by pleating an originally rectangular sheet of absorbent paper or cloth along one long edge (7) to form a trapezoidal shape where the pleated edge (7) is generally semi-circular in shape as shown in FIG. 1. Adjacent to the pleated edge at one corner, fastening means (3), such as adhesive tape tabs are attached.

The semi-circular pleated edge (7) is attached to the wrist area of the wearer. The protector/napkin flares out to its ultimate width at the opposite edge (2) which encircles the upper forearm of the wearer around the elbow.

The protector/napkin can be constructed of absorbent flexible materials such as hand towels, paper towels or napkin type products with several stamped or pressed pleats along one side. These pleats would be approximately ¼ inch wide beginning approximately 1 inch from one corner to produce a slightly semi-circular curve equaling ⅓ of the width of the original width of the sheet to accomodate application at the wrist.

An adhesive tape tab(similar to a fastening means on a disposable diaper) affixes at the wrist area. The tab (3)

is located along a side edge (4) approximately ½ inch to 1½ inches from the pleated edge (7).

The napkin/protector is of a length to allow extension from the wrist of the wearer up the forearm to approximately the elbow area. However, the protector can be constructed of any size desired such as to use over long sleeve or bulky clothing. The napkin/protector can be made of any flexible absorbent materials desired and of any thickness desired.

The pressed pleats can then be expanded when not worn to return the napkin to its original larger rectangular shape thereby allowing the sheet to be used as a napkin.

An alternative embodiment, the re-usable cloth napkin/protector, as shown in FIG. 1A can be constructed in the same manner as seen in FIG. 1. The only difference being that the sheet is cloth instead of paper and the use of hook and loop type fasteners attached by known adhesive or sewing methods as shown in FIG. 1A, reference numbers 3, 3A, 5 and 5A. The use of heavier fabric materials would require the additional fastening means nearer the elbow area (reference numbers 5*a* and 5).

I claim:

1. A combination napkin and sleeve protector comprised of an absorbent and flexible paper or cloth sheet rectangular in shape when laid out flat in a stretched condition and having been pleated at a narrow edge thereof thereby creating a trapezoidally shaped sheet with the narrower edge placed at the wrist of a wearer, encompassing the forearm in a tubular fashion and fastenened by tape tabs or hook and loop type fasteners located on opposite sides of the sheet adjacent the pleated edge so as to allow the fastening of the sheet around the forearm without restricting the hands or the fingers.

2. A combination napkin and sleeve protector as claimed in claim 1 wherein said paper or cloth is flame retardent.

3. A combination napkin and sleeve protector as claimed in claim 1 wherein said paper or cloth is chemical resistant.

* * * * *